US008822964B2

(12) United States Patent
Sakashita

(10) Patent No.: US 8,822,964 B2
(45) Date of Patent: Sep. 2, 2014

(54) RADIOACTIVE SUBSTANCE STORAGE CONTAINER

(75) Inventor: Kiichiro Sakashita, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 63 days.

(21) Appl. No.: 13/634,474

(22) PCT Filed: Apr. 20, 2011

(86) PCT No.: PCT/JP2011/059722
§ 371 (c)(1),
(2), (4) Date: Sep. 12, 2012

(87) PCT Pub. No.: WO2011/148742
PCT Pub. Date: Dec. 1, 2011

(65) Prior Publication Data

US 2013/0001446 A1 Jan. 3, 2013

(30) Foreign Application Priority Data

May 25, 2010 (JP) ..... 2010-119905

(51) Int. Cl.
*G21F 5/00* (2006.01)
*G21F 5/008* (2006.01)
*G21F 9/36* (2006.01)

(52) U.S. Cl.
CPC . *G21F 5/008* (2013.01); *G21F 9/36* (2013.01)
USPC ..... 250/505.1; 250/506.1; 250/507.1

(58) Field of Classification Search
CPC ..... G21F 5/12
USPC ..... 250/505.1
See application file for complete search history.

(56) References Cited

U.S. PATENT DOCUMENTS

| | | | | |
|---|---|---|---|---|
| 4,326,130 | A | 4/1982 | Ahner et al. | |
| 4,532,104 | A | 7/1985 | Wearden et al. | |
| 4,718,552 | A * | 1/1988 | Rossi et al. | 206/308.3 |
| 4,752,437 | A | 6/1988 | Ito et al. | |
| 4,827,139 | A * | 5/1989 | Wells et al. | 250/507.1 |
| 4,880,088 | A * | 11/1989 | De Oliveira | 188/377 |
| 6,234,311 | B1 * | 5/2001 | Francois | 206/521 |
| 6,953,125 | B2 * | 10/2005 | Mingot et al. | 220/1.5 |

FOREIGN PATENT DOCUMENTS

| | | | |
|---|---|---|---|
| JP | 53-090597 | A | 8/1978 |
| JP | 55-059394 | A | 5/1980 |
| JP | 57-179699 | A | 11/1982 |

(Continued)

OTHER PUBLICATIONS

International Search Report of PCT/JP2011/059722, mailing date of Jun. 14, 2011.

(Continued)

*Primary Examiner* — Phillip A Johnston
(74) *Attorney, Agent, or Firm* — Westerman, Hattori, Daniels & Adrian, LLP

(57) ABSTRACT

A radioactive substance storage container 100 includes a body 10 and a lid 10 having a sealed structure, and a basket 5 housed in the body 1 to hold fuel assemblies. The basket 5 includes a neutron shielding material. The radioactive substance storage container 100 includes a subcritical-performance reinforcing member 20 including a neutron shielding material and located between an inner periphery of the body 1 and an outer periphery of the basket 5.

3 Claims, 5 Drawing Sheets

(56) References Cited

FOREIGN PATENT DOCUMENTS

| | | | |
|---|---|---|---|
| JP | 59-132396 | A | 7/1984 |
| JP | 64-026194 | A | 1/1989 |
| JP | 08-194092 | A | 7/1996 |
| JP | 2000-275391 | A | 10/2000 |
| JP | 2006-505780 | A | 2/2006 |
| JP | 4241869 | B2 | 3/2009 |
| WO | 2004/044925 | A2 | 5/2004 |

OTHER PUBLICATIONS

Written Opinion of PCT/JP2011/059722, mailing date of Jun. 14, 2011.

European Search Report dated Sep. 23, 2013, issued in European Patent Application No. 11786442.1.

* cited by examiner

RADIOACTIVE SUBSTANCE STORAGE CONTAINER

FIELD

The present invention relates to a radioactive substance storage container, and more particularly to a radioactive substance storage container that can further improve subcritical safety of the container as well as neutron shielding performance of a basket.

BACKGROUND

In recent years, such a method (a plutonium-thermal method) has been proposed that fuel assemblies for a PWR (Pressurized Water Reactor) or a BWR (Boiling Water Reactor) having used for nuclear power generation are recovered and stored in a radioactive substance storage container, transported to storage facilities, kept therein for a certain period of time, and then recycled. In such a radioactive substance storage container, it is desired to further improve the subcritical safety thereof in storing fuel such as high-burnup spent fuel, fuel having uranium enriched to a degree higher than the existing fuel, or MOX fuel (Mixed Oxide Fuel) in the radioactive substance storage container.

To resolve this issue, a conventional radioactive substance storage container includes a body and a lid having a sealed structure, and a basket stored in the body to hold the fuel assemblies. The basket has neutron shielding performance, thereby increasing subcritical safety of the container. A technique described in Patent Literature 1 is known as an example of the conventional radioactive substance storage container with this configuration.

CITATION LIST

Patent Literature

Patent Literature 1: Japanese Patent No. 4241869

SUMMARY

Technical Problem

The present invention has been achieved in view of the above problems, and an object of the present invention is to provide a radioactive substance storage container that can further improve subcritical safety of the container in addition to the neutron shielding performance of a basket.

Solution to Problem

According to an aspect of the present invention, there is a provided a radioactive substance storage container including a body and a lid having a sealed structure, and a basket housed in the body to hold fuel assemblies, the radioactive substance storage container including a subcritical-performance reinforcing member including a neutron shielding material and being located at least one of between an inner periphery of the body and an outer periphery of the basket, between a bottom surface of the body and a bottom surface of the basket, and between a bottom surface of the lid and an upper surface of the basket.

In the radioactive substance storage container, the subcritical-performance reinforcing member is located to surround the outer periphery of the basket and thus neutrons emitted from the fuel assemblies are shielded not only by the basket but also by the subcritical-performance reinforcing member. Accordingly, subcritical safety of the container is further improved. Furthermore, by arranging the subcritical-performance reinforcing member also on the bottom of the radioactive substance storage container and on the inner surface side of the lid, the neutrons can be shielded in all directions, thereby further improving the subcritical safety of the container.

According to another aspect of the present invention, there is a provided a radioactive substance storage container according to claim 1, wherein the subcritical-performance reinforcing member is located between the inner periphery of the body and the outer periphery of the basket, between the bottom surface of the body and the bottom surface of the basket, and between the bottom surface of the lid and the upper surface of the basket.

In the radioactive substance storage container according to the present invention, the subcritical-performance reinforcing member is located between the inner periphery of the body and the outer periphery of the basket, between the bottom surface of the body and the bottom surface of the basket, and between the bottom surface of the lid and the upper surface of the basket.

According to another aspect of the present invention, there is a provided a radioactive substance storage container, wherein the subcritical-performance reinforcing member has a shock-absorbing structure.

In the radioactive substance storage container, when an impact is applied by a falling accident during transport or the like and if the impact is applied to the inside, the impact is absorbed by a shock-absorbing unit located between the body and the basket, between the basket and the bottom of the body, or between the basket and the inner peripheries of the body and the lid. Accordingly, safety against impacts is improved.

Advantageous Effects of Invention

In the radioactive substance storage container according to the present invention, because the subcritical-performance reinforcing member is located to surround the outer periphery of the basket, neutrons emitted from the fuel assemblies are shielded not only by the basket but also by the subcritical-performance reinforcing member. Accordingly, subcritical safety of the container is further improved. Furthermore, by locating the subcritical-performance reinforcing member also on the bottom of the radioactive substance storage container and on the inner surface side of the lid, the neutrons can be shielded in all directions, thereby further improving the subcritical safety of the container.

DESCRIPTION OF EMBODIMENTS

The present invention will be explained below in detail with reference to the accompanying drawings. The present invention is not limited the following embodiments. Constituent elements in the following embodiments include those that can be replaceable while maintaining the unity of the invention and obviously replaceable. In addition, modifications described in the following embodiments can be arbitrarily combined with each other within the scope obvious to persons skilled in the art.

[Radioactive Substance Storage Container]

Figure 1:
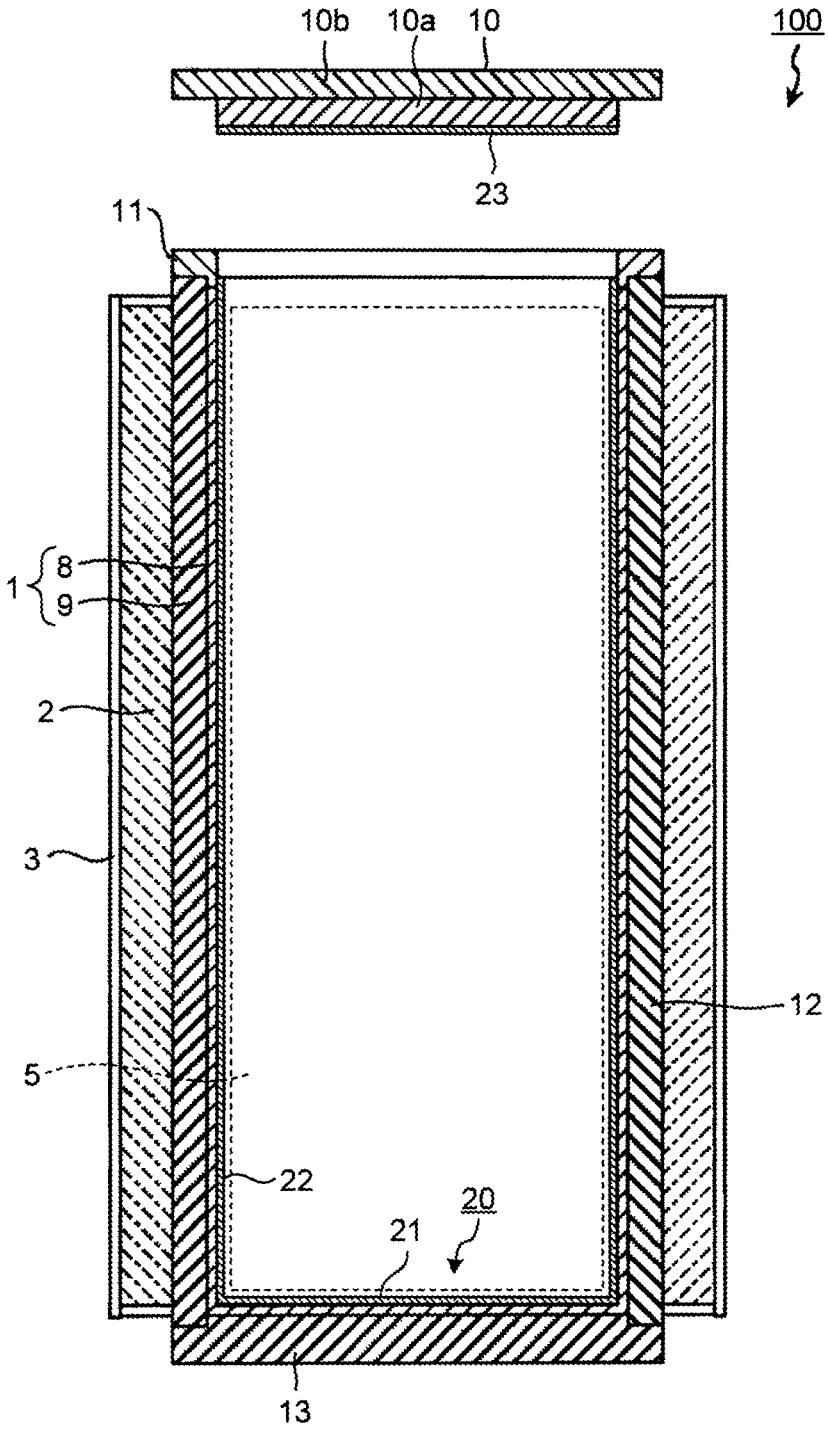
FIG. 1 is an axial sectional view of a radioactive substance storage container according to an embodiment of the present invention.
Figure 2:
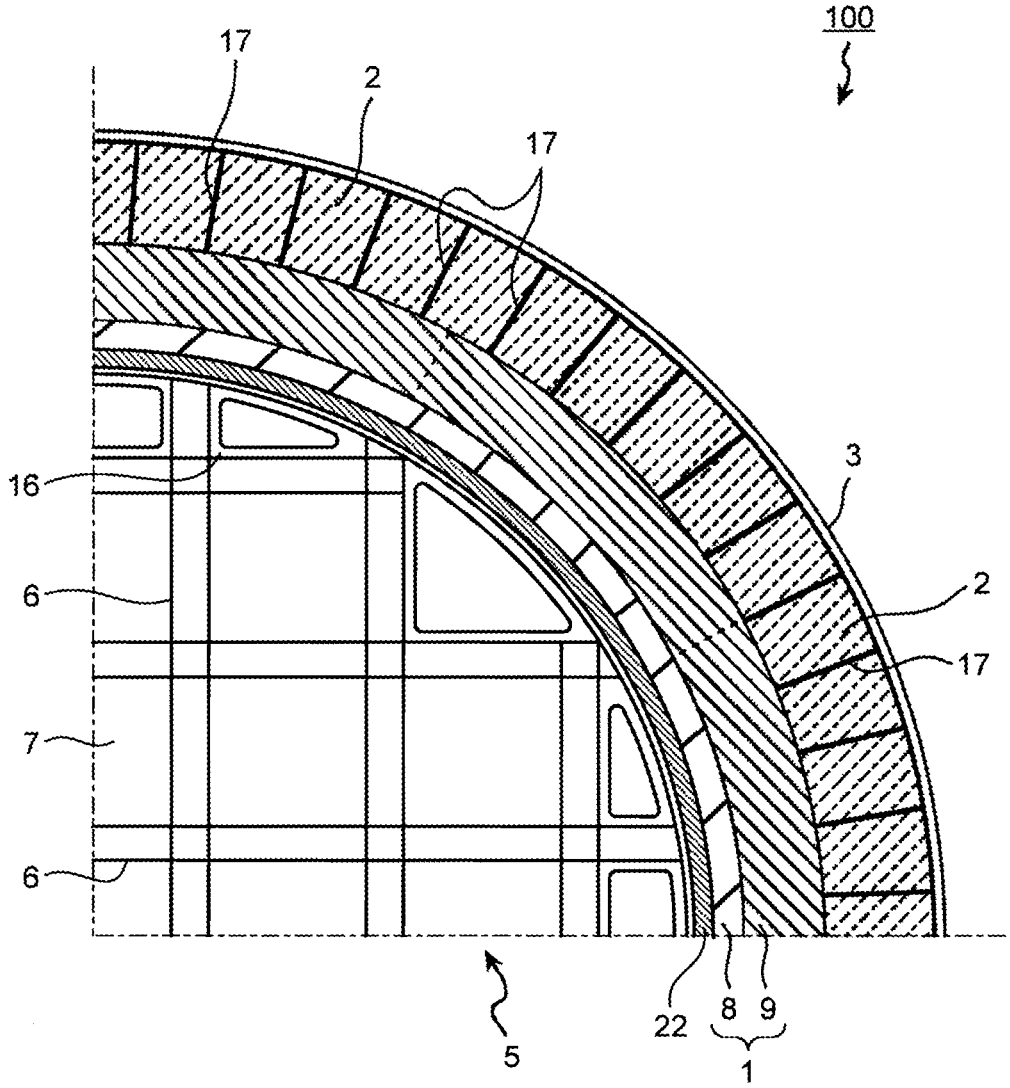
FIG. 2 is a radial sectional view of the radioactive substance storage container shown in FIG. 1.
Figure 3:
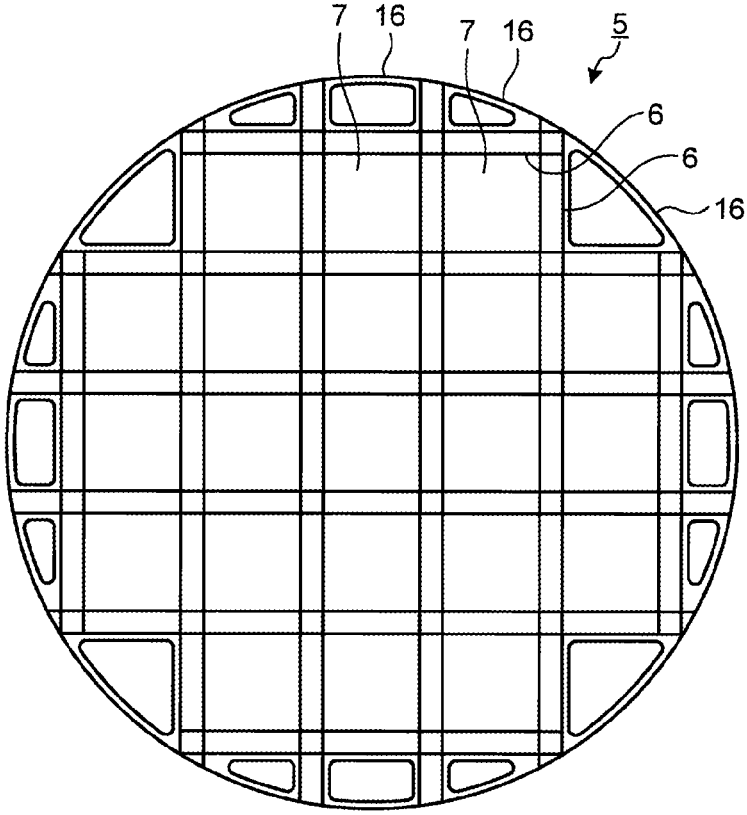
FIG. 3 is a plan view of a basket of the radioactive substance storage container shown in FIG. 1.
Figure 4:
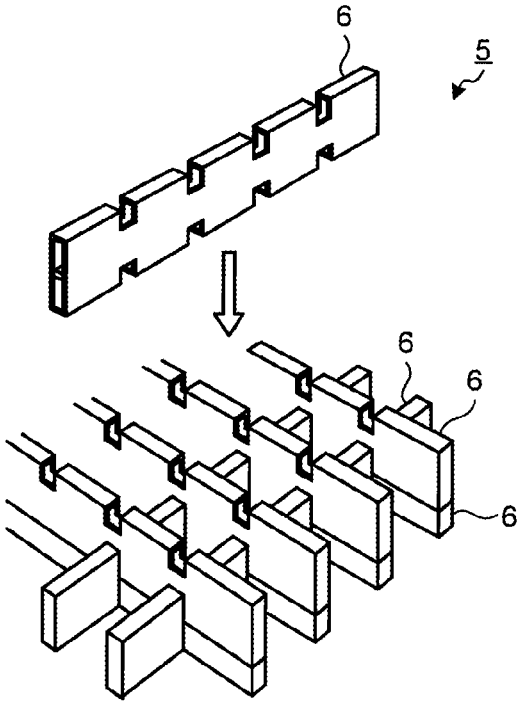
FIG. 4 is an assembled perspective view of the basket of the radioactive substance storage container shown in FIG. 1.

FIG. 1 is an axial sectional view of a radioactive substance storage container according to an embodiment of the present invention. FIG. 2 is a radial sectional view of the radioactive substance storage container shown in FIG. 1. FIGS. 3 and 4 are a plan view (FIG. 3) and an assembled perspective view (FIG. 4) of a basket of the radioactive substance storage container shown in FIG. 1, respectively.

This radioactive substance storage container 100 is a container (a so-called "cask") that has fuel assemblies stored therein. In recent years, the method (plutonium-thermal method) in which fuel assemblies for a PWR (Pressurized Water Reactor) or a BWR (Boiling Water Reactor) having used for nuclear power generation are recovered and stored in the radioactive substance storage container 100, transported to storage facilities, kept therein for a certain period of time, and then recycled has been proposed and executed.

The radioactive substance storage container 100 includes a body 1, a neutron shielding body 2, an external cylinder 3, a basket 5, and a lid 10 (see FIG. 1).

The body 1 has a bottomed integral structure formed of a material such as stainless steel, carbon steel, or alloy steel. A double structure of the body 1 is mainly explained here. The body 1 has an inner container 8 mainly having seal performance and an outer container 9 mainly having γ-ray shielding performance. The inner container 8 has a bottomed integral structure formed of a material such as stainless steel, carbon steel, or alloy steel. The seal performance of the inner container 8 is improved by the bottomed integral structure. The inner container 8 also has a flange 11 on an opening end face, to which the lid 10 is attached. The outer container 9 is formed of a material such as stainless steel, carbon steel, or alloy steel, and has such a structure that a cylindrical body 12 and a bottom plate 13 thicker than the inner container 8 are integrated by butt welding. The seal performance and mechanical strength of the outer container 9 is improved by the butt welding. The inner container 8 and the outer container 9 are assembled by inserting the inner container 8 into the outer container 9 and shrink-fitting, cooling-fitting, or mating the inner container 8 to the outer container 9.

The neutron shielding body 2 is a cylindrical body that shields neutrons, and located to surround an outer periphery of the body 1. For example, in the present embodiment, spaces sectioned by a plurality of heat transfer fins 17 are formed between the body 1 and the external cylinder 3 (see FIG. 2). The neutron shielding body 2 is filled and molded in these spaces. Furthermore, the neutron shielding body 2 is formed of resin containing a predetermined amount of hydrogen and being added with boron or a boron compound, and the heat transfer fins 17 are formed of a material having high heat conductivity (for example, copper or aluminum).

The external cylinder 3 is a thin cylindrical body and is located to surround an outer periphery of the neutron shielding body 2.

The basket 5 is a frame-like body for holding the fuel assemblies, and is inserted into and fixed to the inner container 8 of the body 1 (see FIGS. 1 and 2). The basket 5 is formed of a material in which boron or a boron compound is added to an aluminum material or aluminum alloy. For example, in the present embodiment, the basket 5 has a structure in which a plurality of boards 6 are engaged with each other and assembled into grids, and has substantially a honeycomb columnar shape along an inner diameter of the body 1 (the inner container 8) as a whole (see FIGS. 3 and 4). The basket 5 has a plurality of long cells 7 divided by the boards 6, and the fuel assemblies can be inserted into the cells 7 and held therein. The basket 5 is housed in the inner container 8 of the body 1, and fixed thereto by spot welding. Spacers 16 are inserted into clearances on an outer periphery of the basket 5 (clearances generated on an outer periphery of the assembled boards 6 other than the cells 7). Because the basket 5 has the structure in which the boards 6 are engaged with each other, heat transfer is efficiently performed. Because heat is transferred to the body 1 also via the spacers 16, the heat transfer is performed more efficiently. Accordingly, when the fuel assemblies are housed in the basket 5, decay heat of the fuel assemblies can be efficiently transferred from the basket 5 to the body 1. Even if an impact is applied inside due to a falling accident during transport, durability performance against loads is high because of the structure in which the boards 6 are engaged with each other. Furthermore, structural strength of the basket 5 is increased by the spacer 16.

The lid 10 has a double structure formed by welding two circular boards 10*a* and 10*b*, and has a fitting structure because the inner circular board 10*a* has a small diameter. The inner circular board 10*a* of the lid 10 is fitted into an opening of the inner container 8 of the body 1, and the lid 10 is bolted to the flange 11 of the inner container 8 and fixed thereto. The inside of the body 1 is hermetically sealed by the lid 10. A neutron shielding material (for example, resin containing a predetermined amount of hydrogen) (not shown) is filled and sealed in at least one of the circular boards 10*a* and 10*b* to provide neutron shielding performance. In the present embodiment, the lid 10 has the double structure (see FIG. 1); however, the structure is not limited thereto, and the lid 10 can have a single layer structure or a triple lid structure (not shown).

In the radioactive substance storage container 100, the recovered fuel assemblies are inserted into and housed in the respective cells 7 of the basket 5, and then the lid 10 is fitted to the body 1 to hermetically seal the body 1. In such a configuration, the outer periphery of the basket 5 is hermetically sealed and shielded by the body 1 having the seal performance and the γ-ray shielding performance, and the outer periphery of the body 1 is surrounded by the neutron shielding body 2 formed of the resin layer. Accordingly, the seal performance and γ-ray shielding performance of the radioactive substance storage container 100 can be highly ensured. Furthermore, the outer periphery of the body 1 and the external cylinder 3 are connected via the heat transfer fins 17. Accordingly, the decay heat of the fuel assemblies is transferred to the body 1 via the boards 6 and the spacers 16 of the basket 5, then transferred from the body 1 to the external cylinder 3 via the heat transfer fins 17, and discharged to outside. Accordingly, a structure that can discharge the decay heat of the fuel assemblies is ensured.

[Subcritical-Performance Reinforcing Member]

The radioactive substance storage container 100 includes a subcritical-performance reinforcing member 20 for further improving the subcritical safety (see FIGS. 1 and 2). The subcritical-performance reinforcing member 20 includes a neutron shielding material, and is located at least one of between an inner periphery of the body 1 and the outer periphery of the basket 5, between a bottom surface of the body 1 and a bottom surface of the basket 5, and between a bottom surface of the lid 10 and an upper surface of the basket 5.

For example, in the present embodiment, the subcritical-performance reinforcing member 20 is formed of a material in which boron or a boron compound is added to a steel material, aluminum material, or aluminum alloy, or a material in which boron or a boron compound is placed between steel materials, aluminum materials, or aluminum alloys to form a laminate structure. Addition of boron can be performed by melting boron together with an aluminum base material, or adding boron powder in aluminum powder and mixing these by a mixer or by mechanical alloying. The subcritical-performance reinforcing member 20 has a thickness of 1 to 5 [mm], and preferably, 2 to 4 [mm]. In an assembled state of the radioactive substance storage container 100, a clearance between the inner periphery of the body 1 and the outer periphery of the basket 5 is set to 5 [mm] to 10 [mm], and a clearance between an internal surface of the lid 10 and the upper surface of the basket 5 is set to about 50 [mm]. The thickness of the subcritical-performance reinforcing member, the clearance between the inner periphery of the body 1 and the outer periphery of the basket 5, and the clearance between the internal surface of the lid 10 and the upper surface of the basket 5 depend on a design of the radioactive substance storage container, and are not limited to those described above.

The subcritical-performance reinforcing member 20 includes a bottom-surface unit 21, a side-surface unit 22, and a lid-surface unit 23. The bottom-surface unit 21 is a part located between the inner bottom surface of the body 1 and the bottom surface of the basket 5, and has a disk-like shape along the inner bottom surface of the body 1 (the inner container 8). The side-surface unit 22 is a part located between the inner periphery of the body 1 and the outer periphery of the basket 5, and has a cylindrical shape along the inner periphery of the body 1. The lid-surface unit 23 is a part located between the bottom surface of the lid 10 and the upper surface of the basket 5, and has a disk-like shape along the bottom surface of the lid 10. The bottom-surface unit 21, the side-surface unit 22, and the lid-surface unit 23 are formed to surround the entire basket 5 and substantially seal the basket 5. Accordingly, the neutron shielding performance is enhanced. In the present embodiment, the shape of the subcritical-performance reinforcing member 20 is the disk-like shape. However, a suitable shape can be selected according to a shape of the radioactive substance storage container 100.

The bottom-surface unit 21 and the side-surface unit 22 have a bottomed container shape integrally formed (see FIG. 1). Such a configuration is preferable because the bottom-surface unit 21 and the side-surface unit 22 have no shut and accordingly the seal performance is improved and weld hardening or weld cracking due to an influence of heat hardly occurs as compared to a configuration in which the bottom-surface unit 21 and the side-surface unit 22 are welded and joined. However, the configuration thereof is not limited thereto, and the bottom-surface unit 21 and the side-surface unit 22 can be separate structures or the side-surface unit 22 can be formed of a plurality of segments radially divided (not shown). These configurations are preferred in that workability of the bottom-surface unit 21 and the side-surface unit 22 is improved.

Figure 7:
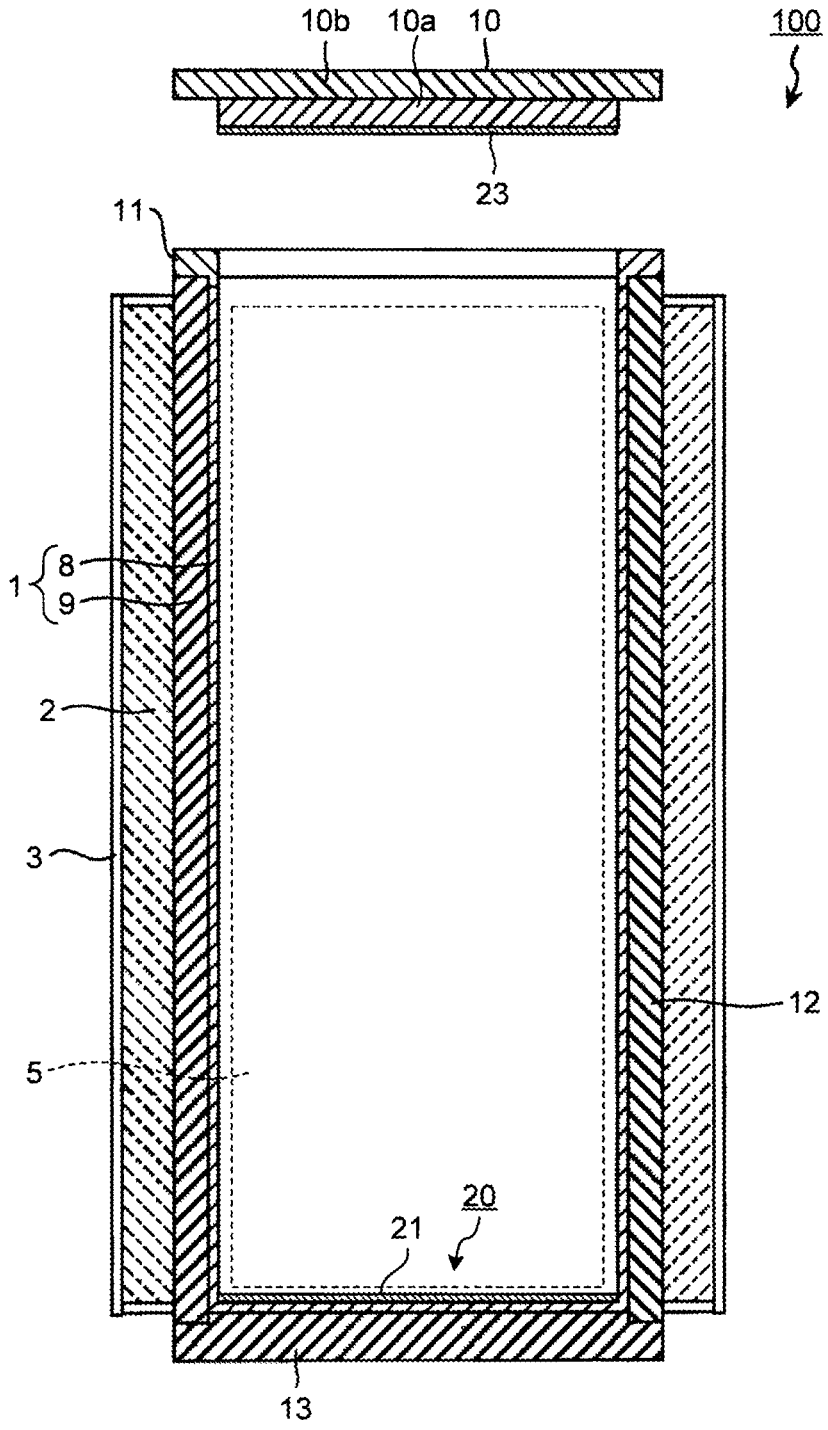
FIG. 7 is an axial sectional view of a modification of the radioactive substance storage container shown in FIG. 1.

There is a modification of the subcritical-performance reinforcing member 20, which includes only the bottom-surface unit 21 and the lid-surface unit 23 (see FIG. 7). The radioactive substance storage container 100 including this subcritical-performance reinforcing member 20 is preferable in that in a case in which an impact of, for example, a falling accident during transport is applied to a lid side or a bottom side of the radioactive substance storage container 100, criticality can be prevented even if the impact is applied to the fuel assemblies housed therein.

In an assembly process of the radioactive substance storage container 100, the bottom-surface unit 21 and the side-surface unit 22 are first attached to the inner periphery of the body 1 (the inner container 8) and then the basket 5 is carried in and installed in the body 1 (not shown). This configuration is preferred in that the bottom-surface unit 21 and the side-surface unit 22 can be accurately installed along the inner periphery of the body 1 (particularly, without a clearance therebetween when the bottom-surface unit 21 and the side-surface unit 22 have divided structures). However, the configuration is not limited thereto, and the bottom-surface unit 21 or the side-surface unit 22 can be first attached to the bottom surface or the outer periphery of the basket 5 and then an assembly of remaining one of the bottom-surface unit 21 and the side-surface unit 22 and the basket 5 can be carried into the body 1 and installed therein (not shown). Such a configuration is preferable in that the bottom-surface unit 21 or the side-surface unit 22 can be accurately installed with respect to the basket 5 (particularly, without a clearance therebetween when the bottom-surface unit 21 and the side-surface unit 22 have the divided structures). In any configuration, the neutron shielding performance is enhanced by arranging the bottom-surface unit 21 or the side-surface unit 22 at a position closer to the basket 5 than the body 1.

The lid-surface unit 23 is installed by being attached to the circular board 10*a* on the bottom side of the lid 10 (see FIG. 1). In the installed state of the lid 10, the lid-surface unit 23 closes an opening of the side-surface unit 22. Accordingly, the neutron shielding performance on the side of the lid 10 is enhanced. Thus, the configuration in which the lid-surface unit 23 is attached to the bottom side of the lid 10 is preferable because handling and installation of the lid-surface unit 23 is easy. However, the configuration is not limited thereto, and the lid-surface unit 23 can be installed on the upper surface of the basket 5 after the fuel assemblies are housed in the basket 5, and then the lid 10 can be attached to the body 1 (not shown). The radioactive substance storage container 100 according to the present embodiment adopts the structure in which the subcritical-performance reinforcing member 20 is attached to the body 1, the lid 10, and the basket 5. However, the subcritical-performance reinforcing member 20 is not necessarily attached thereto, and such a structure that the subcritical-performance reinforcing member 20 is installed in a space between an area formed by the body 1 and the lid 10 and the basket can be adopted. Furthermore, such a structure that only a part of the subcritical-performance reinforcing member 20 (for example, the lid-surface unit 23) is attached, and the other parts of the subcritical-performance reinforcing member (for example, the bottom-surface unit 21 and the side-surface unit 22) are not attached but are only installed can be adopted.

[Shock-Absorbing Structure of Subcritical-Performance Reinforcing Member]

Figure 5:
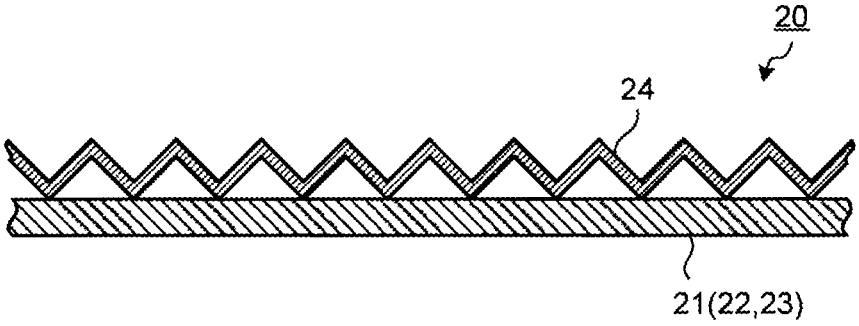
FIG. 5 is a sectional view of a modification of a subcritical-performance reinforcing member of the radioactive substance storage container shown in FIG. 1.
Figure 6:
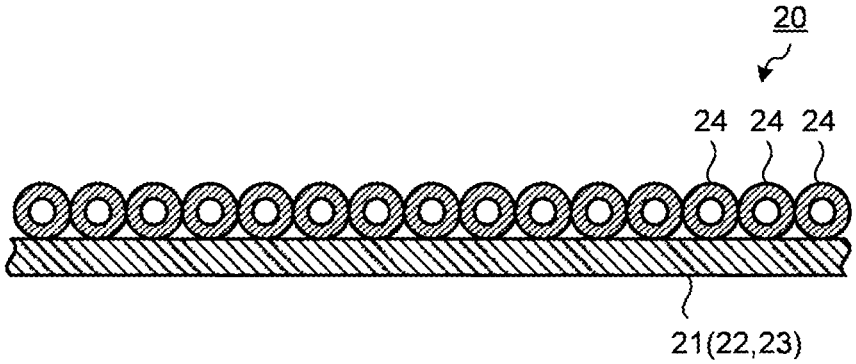
FIG. 6 is a sectional view of another modification of the subcritical-performance reinforcing member of the radioactive substance storage container shown in FIG. 1.

FIGS. 5 and 6 are sectional views of a modification of the subcritical-performance reinforcing member of the radioactive substance storage container shown in FIG. 1.

The subcritical-performance reinforcing member 20 according to the modification includes a shock-absorbing unit 24. The shock-absorbing unit 24 is formed of a plate-like member having an accordion cross section (see FIG. 5) or a plurality of crushable pipe members (see FIG. 6). In such a configuration, when an impact is applied to the inside due to a falling accident during transport, the impact is absorbed by the shock-absorbing unit 24 located between the body 1 and the basket 5. Accordingly, safety against impacts is improved.

For example, in the modifications, the bottom-surface unit 21, the side-surface unit 22, and the lid-surface unit 23 of the subcritical-performance reinforcing member 20 and the shock-absorbing unit 24 are formed of different materials, and these are stacked to constitute the subcritical-performance reinforcing member 20 (see FIGS. 5 and 6). Furthermore, the shock-absorbing unit 24 is formed of, for example, a steel material. Accordingly, the neutron shielding material is used only for the bottom-surface unit 21, the side-surface unit 22, and the lid-surface unit 23, thereby reducing production costs of the subcritical-performance reinforcing member 20. Because the shock-absorbing unit 24 is formed of a different material from those of the other units 21 to 23 including the neutron shielding material, even if the shock-absorbing unit 24 is crushed due to an impact, the other units 21 to 23 including the neutron shielding material can remain without being broken. Accordingly, the neutron shielding performance, which is a principal object of the subcritical-performance reinforcing member 20, is ensured appropriately. A total thickness of the subcritical-performance reinforcing member 20 including the shock-absorbing unit 24 is set to a range that can be fit inside the clearance between the body 1 and the basket 5.

[Effect]

As explained above, the radioactive substance storage container 100 includes the subcritical-performance reinforcing member 20 including the neutron shielding material and located between the inner periphery of the body 1 and the outer periphery of the basket 5 (see FIGS. 1 and 2). In this configuration, because the subcritical-performance reinforcing member 20 is located to surround the outer periphery of the basket 5, neutrons emitted from the fuel assemblies are shielded not only by the basket 5 but also by the subcritical-performance reinforcing member 20. Accordingly, subcritical safety of the container is further improved. By locating the subcritical-performance reinforcing member 20 also on the bottom of the radioactive substance storage container 100 and on the inner surface side of the lid, the neutrons can be shielded in all directions, thereby further improving the subcritical safety of the container.

Because the subcritical-performance reinforcing member 20 is located between the body 1 and the basket 5, the neutron shielding performance is higher than in a configuration in which the subcritical-performance reinforcing member is located on the outer periphery of the body 1. Furthermore, because the diameter of the subcritical-performance reinforcing member 20 can be made smaller, a use amount of the neutron shielding material and the weight of the container can be reduced. Because the subcritical-performance reinforcing member 20 is placed between the body 1 and the basket 5, decay heat of the fuel assemblies can be transferred from the basket 5 to the body 1 via the subcritical-performance reinforcing member 20. Accordingly, the decay heat of the fuel assemblies can be efficiently discharged.

In the radioactive substance storage container 100, it is desired that the subcritical-performance reinforcing member 20 be attached to and arranged on the inner periphery of the body 1. In this configuration, the subcritical-performance reinforcing member 20 can be accurately installed along the inner periphery of the body 1.

In the radioactive substance storage container 100, it is desired that the subcritical-performance reinforcing member 20 be attached to and arranged on the outer periphery of the basket 5. In this configuration, the subcritical-performance reinforcing member 20 can be accurately installed along the outer periphery of the basket 5.

In the radioactive substance storage container 100, it is desired that the subcritical-performance reinforcing member 20 have a shock-absorbing structure (the shock-absorbing unit 24) (see FIGS. 5 and 6). In this configuration, when an impact is applied to the inside due to a falling accident during transport, the impact is absorbed by the shock-absorbing unit 24 located between the body 1 and the basket 5. Accordingly, safety against impacts is improved.

INDUSTRIAL APPLICABILITY

As described above, the radioactive substance storage container according to the present invention is advantageous in that the subcritical safety of the container as well as the neutron shielding performance of the basket can be further improved.

REFERENCE SIGNS LIST

1 body
2 neutron shielding body
3 external cylinder
5 basket
6 board
7 cell
8 inner container
9 outer container
10 lid
10*a*, 10*b* circular board
11 flange
12 cylindrical body
13 bottom plate
16 spacer
17 heat transfer fin
20 subcritical-performance reinforcing member
21 bottom surface
22 side surface
23 lid surface
24 shock-absorbing unit
100 radioactive substance storage container

The invention claimed is:

1. A radioactive substance storage container including a body and a lid having a sealed structure, and a basket housed in the body to hold fuel assemblies, the radioactive substance storage container comprising a subcritical-performance reinforcing member including a neutron shielding material and being located at least one of between an inner periphery of the body and an outer periphery of the basket, between a bottom surface of the body and a bottom surface of the basket, and between a bottom surface of the lid and an upper surface of the basket, wherein the subcritical-performance reinforcing member has a shock-absorbing structure having a shock-absorbing unit, the shock-absorbing unit being formed of a plate-like member having an accordion cross section or a plurality of crushable pipe members.

2. The radioactive substance storage container according to claim 1, wherein the subcritical-performance reinforcing member is located between the bottom surface of the body and the bottom surface of the basket, and between the bottom surface of the lid and the upper surface of the basket.

3. The radioactive substance storage container according to claim 1, wherein the subcritical-performance reinforcing member is located between the inner periphery of the body and the outer periphery of the basket, between the bottom surface of the body and the bottom surface of the basket, and between the bottom surface of the lid and the upper surface of the basket.

* * * * *